US010077929B2

(12) United States Patent
Fraser et al.

(10) Patent No.: US 10,077,929 B2
(45) Date of Patent: Sep. 18, 2018

(54) MOVEMENT OF ELECTRONIC EXPANSION VALVE

(71) Applicant: Carrier Corporation, Farmington, CT (US)

(72) Inventors: Eric B. Fraser, Canastota, NY (US); Arthur F. Friday, Jr., Huntersville, NC (US); Michael R. Cote, Terryville, CT (US); Jing Ou, South Windsor, CT (US); Mehmood Syed, Cheshire, CT (US)

(73) Assignee: CARRIER CORPORATION, Farmington, CT (US)

( * ) Notice: Subject to any disclaimer, the term of this patent is extended or adjusted under 35 U.S.C. 154(b) by 595 days.

(21) Appl. No.: 14/271,595

(22) Filed: May 7, 2014

(65) Prior Publication Data

US 2014/0331694 A1 Nov. 13, 2014

Related U.S. Application Data

(60) Provisional application No. 61/821,027, filed on May 8, 2013.

(51) Int. Cl.
*F25B 49/02* (2006.01)
*F25B 41/04* (2006.01)

(52) U.S. Cl.
CPC ..... *F25B 49/02* (2013.01); *F25B 2400/075* (2013.01); *F25B 2600/0251* (2013.01); *F25B 2600/2513* (2013.01); *F25B 2700/2106* (2013.01)

(58) Field of Classification Search
CPC ..... F25B 49/02; F25B 2700/2106; F25B 2600/2513; F25B 2600/0251; F25B 2400/075
See application file for complete search history.

(56) References Cited

U.S. PATENT DOCUMENTS 5,303,562 A 4/1994 Bahel et al.
5,329,462 A * 7/1994 Friday ..... F25B 41/062 62/210
5,551,248 A * 9/1996 Derosier ..... F24F 11/0009 62/155
5,632,154 A 5/1997 Sibik et al.
6,085,533 A * 7/2000 Kaido ..... F25B 49/022 62/196.2
6,089,034 A 7/2000 Lake et al.
6,092,376 A 7/2000 Lake et al.
6,148,628 A 11/2000 Reason et al.
6,453,691 B1 * 9/2002 Seo ..... F25B 49/022 62/228.5
6,711,911 B1 3/2004 Grabon et al.
7,784,296 B2 8/2010 Chen et al.
8,191,377 B2 6/2012 Aiyama et al.
(Continued)

FOREIGN PATENT DOCUMENTS

CN 101446463 A 6/2009
JP H02272261 A 11/1990

*Primary Examiner* — Kun Kai Ma
(74) *Attorney, Agent, or Firm* — Cantor Colburn LLP

(57) ABSTRACT

Embodiments are directed to receiving, by a device comprising a processor, an indication that an air conditioning unit should turn on, commanding, by the device, a valve to open a specified extent based on the received indication, and subsequent to the valve opening to the specified extent, powering-on a piece of equipment that has an impact on refrigerant flow in the air conditioning unit.

18 Claims, 5 Drawing Sheets

(56) References Cited

U.S. PATENT DOCUMENTS

2005/0193749 A1* 9/2005 Hwang ..... F25B 13/00 62/160
2006/0112705 A1* 6/2006 Jin ..... F25B 49/022 62/228.5
2006/0162358 A1* 7/2006 VanderZee ..... F25B 49/02 62/225
2007/0266719 A1* 11/2007 Kang ..... F24F 11/001 62/228.5
2008/0216500 A1* 9/2008 Chen ..... F25B 41/062 62/225
2009/0031740 A1* 2/2009 Douglas ..... F25B 13/00 62/225
2009/0235678 A1* 9/2009 Taras ..... F24F 3/153 62/115
2009/0288432 A1* 11/2009 Lifson ..... F25B 5/02 62/115
2010/0204840 A1 8/2010 Sun et al.
2011/0097988 A1* 4/2011 Lord ..... F24F 11/0079 454/256
2011/0113797 A1 5/2011 Peyaud et al.
2011/0232311 A1 9/2011 Korenaga et al.
2011/0314841 A1 12/2011 Turner et al.
2012/0167602 A1* 7/2012 Taras ..... F25B 49/02 62/115
2013/0098086 A1* 4/2013 Sillato ..... F25B 49/02 62/184
2013/0160474 A1* 6/2013 Qu ..... F25B 41/062 62/222
2013/0340452 A1* 12/2013 Kleman ..... F25B 41/043 62/115

* cited by examiner

MOVEMENT OF ELECTRONIC EXPANSION VALVE

CROSS-REFERENCE TO RELATED APPLICATIONS

This application claims the benefit of U.S. provisional patent application Ser. No. 61/821,027, filed May 8, 2013, the entire contents of which are incorporated herein by reference.

BACKGROUND

Manufacturers of air conditioners are seeking out low cost technologies in order to provide high efficiency products. Micro-channel heat exchanger (MCHX) coils may be used in such products. MCHX coils weigh less, require less refrigerant, and are less costly to manufacture than round tube plate fin (RTPF) coils, while providing the same or better performance in terms of, e.g., heat rejection. However, because of the decreased interior volume of MCHX coils, less refrigerant is able to be stored or pushed through, which could result in pressure spikes. Such pressure spikes may occur during unit start, during compressor staging, or during outdoor fan staging. Such pressure spikes may be present when the unit is used during high outdoor ambient conditions (e.g., temperature).

Air conditioning units/products may incorporate a thermal expansion valve (TXV). A TXV may open and close a port to control an expansion of refrigerant. The TXV is a mechanical device that opens and closes based on temperature. Based on its principle of operation, the TXV does not react (e.g., does not open) fast enough to a unit being turned on or staged, which may result in a back-up of refrigerant and a build-up of pressure on a discharge side of a compressor. Due to the pressure build-up, the unit may be shutoff for safety purposes. These nuisance types of shutoffs may result in user dissatisfaction. Such dissatisfaction may be particularly pronounced because the unit might not cool on very hot days when such cooling is needed the most.

BRIEF SUMMARY

An embodiment of the disclosure is directed to a method for operating an air conditioning unit, comprising: receiving, by a device comprising a processor, an indication that the air conditioning unit should turn on, commanding, by the device, a valve to open a specified extent based on the received indication, and subsequent to the valve opening to the specified extent, powering-on a piece of equipment that has an impact on refrigerant flow in the air conditioning unit.

An embodiment of the disclosure is directed to an apparatus comprising: at least one processor, and memory having instructions stored thereon that, when executed by the at least one processor, cause the apparatus to: receive an indication that an air conditioning unit should turn on, command a valve to open a specified extent based on the received indication, and subsequent to the valve opening to the specified extent, power-on a piece of equipment that has an impact on refrigerant flow in the air conditioning unit.

An embodiment of the disclosure is directed to an air conditioning unit comprising: an expansion valve, and a computing device configured to prepare a refrigeration circuit for a change in refrigerant flow by changing an extent to which the expansion valve is opened in advance of changing a state of a piece of equipment that has an impact on the refrigerant flow.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
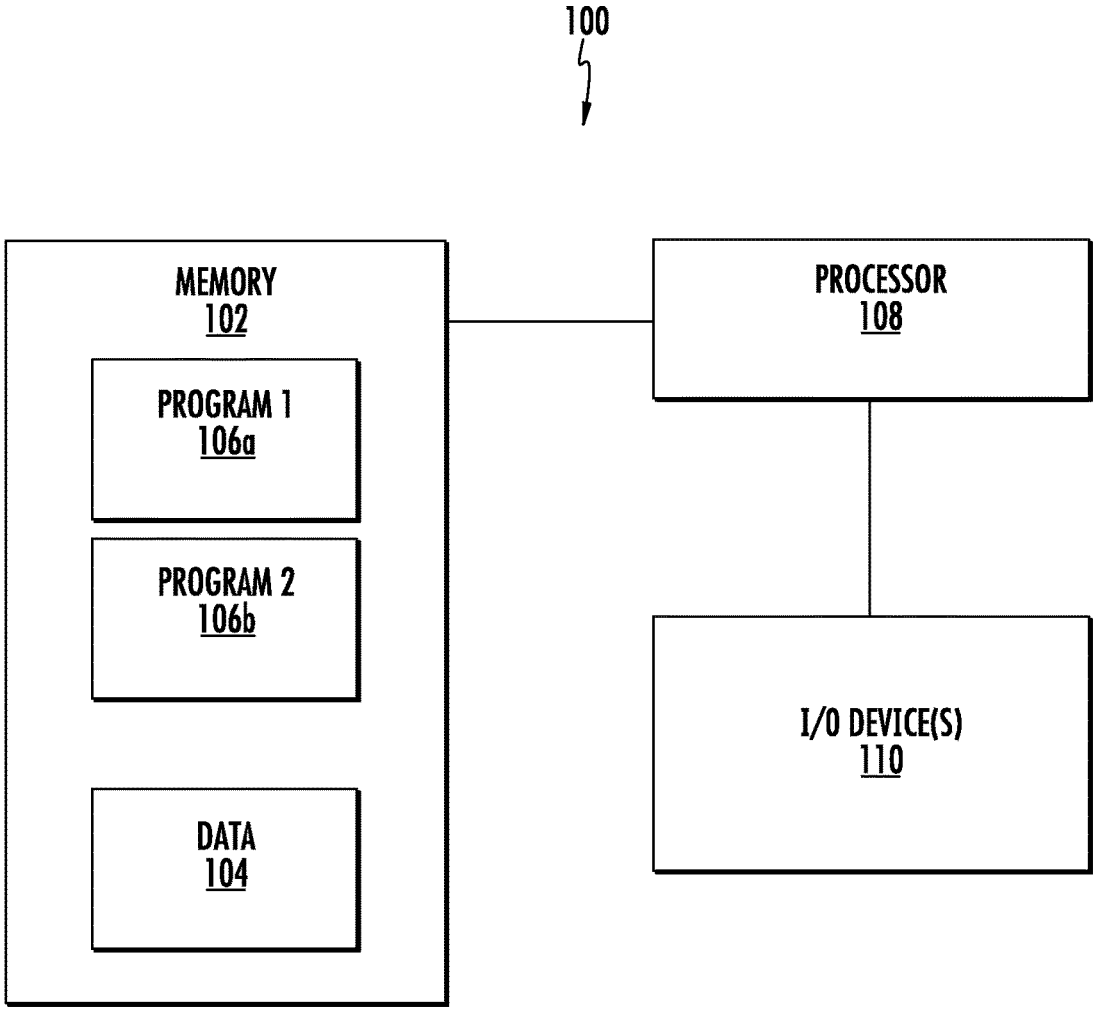
FIG. 1 is a schematic block diagram illustrating an exemplary computing system in accordance with one or more embodiments.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between components may refer to either a direct or an indirect connection.

Exemplary embodiments of apparatuses, systems, and methods are described for reducing or minimizing pressure spikes in an air conditioning system or unit, such as systems or units that include multiple compressors. Such a reduction is realized using one or more electronically-controlled expansion valves (EXVs). A state of the EXVs, in terms of how open or closed the EXVs are, is controlled or regulated based on one or more (electronic) commands, potentially as a function of one or more conditions (e.g., environmental conditions). In some embodiments, the air conditioning unit is included as part of a packaged rooftop air conditioning system.

Referring to FIG. 1, an exemplary computing system 100 is shown. The system 100 is shown as including a memory 102. The memory 102 may store data 104. The memory 102 may store executable instructions. The executable instructions are stored or organized in any manner and at any level of abstraction, such as in connection with one or more processes, routines, procedures, methods, etc. As an example, at least a portion of the instructions are shown in FIG. 1 as being associated with a first program **106*a* and a second program 106*b***.

The instructions stored in the memory 102 are executed by one or more processors, such as a processor 108. The processor 108 may be coupled to one or more input/output (I/O) devices 110. In some embodiments, the I/O device(s) 110 may include one or more of a keyboard or keypad, a touchscreen or touch panel, a display screen, a microphone, a speaker, a mouse, a button, a remote control, a joystick, a printer, a telephone or mobile device (e.g., a smartphone), a thermostat, a sensor, etc. The I/O device(s) 110 may be configured to provide an interface to allow a user to interact with the system 100.

The system 100 is illustrative. In some embodiments, one or more of the components may be optional. In some embodiments, additional components not shown may be included. For example, in some embodiments the system 100 is associated with one or more networks. In some embodiments, the components are arranged or organized in a manner different from what is shown in FIG. 1. One or more of the components shown in FIG. 1 may be associated with one or more of the devices described herein.

Figure 2:
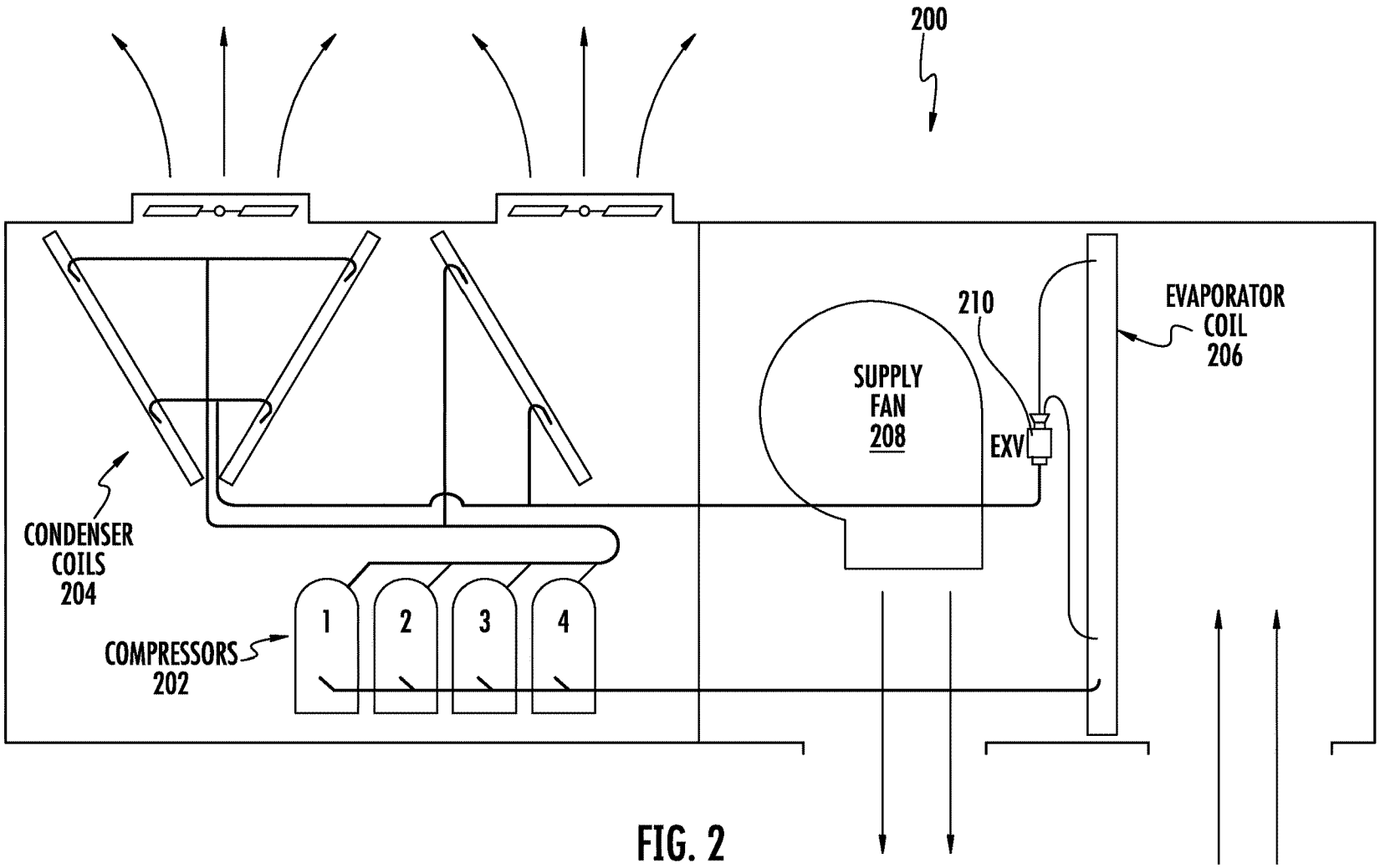
FIG. 2 illustrates an exemplary air conditioning system in accordance with one or more embodiments.

FIG. 2 illustrates an exemplary air conditioning system 200 in accordance with one or more embodiments of the disclosure. As shown, the system 200 includes one or more compressors 202, one or more condenser coils 204, one or more evaporator coils 206, and a supply fan 208. The structure and function of the compressors 202, coils 204, coils 206, and supply fan 208 are generally well-known in the art, and so a complete description of these devices is omitted for the sake of brevity.

The system 200 includes one or more electronically controlled expansion valves (EXVs) 210. The EXV 210 may be opened or closed in a specified amount, and may be expressed in terms of, e.g., a percentage open in a range from 0% (completely shut) to 100% (completely open). When the air conditioning unit/system 200 is off, the EXV 210 typically is commanded to 0% to prevent a charge migration to the colder parts of the system 200.

When the system 200 is commanded to start, which may be based on receipt of a signal from a thermostat, the EXV 210 is commanded to open to a specified percentage before the compressors 202 power-on. One or more formulas or equations are used to determine the extent to which the EXV 210 is commanded to open. For example, the EXV 210 is commanded to open in accordance with equation #1:

$$\%=(m*\mathrm{OAT})+b, \qquad \text{Equation \#1}$$

where 'm' represents a slope and may be equal to 0.133, OAT is equal to a sensed outside air temperature, and 'b' represents a vertical or 'y-intercept' and may be equal to 40.

Once the EXV 210 reaches the position referenced by equation #1 above, a first of the compressors 202-1 is allowed to power-on. The EXV 210 is maintained at this position for a specified first amount of time (e.g., thirty seconds) in order to allow a refrigerant circuit to stabilize. After the specified first amount of time has elapsed, the EXV 210 is allowed to modulate the percentage open automatically to achieve a particular superheat (SH) temperature value. The SH temperature value corresponds to the difference in temperature between a first temperature at which the refrigerant boils at a given pressure in the evaporator 206 and a second temperature of the refrigerant gas as the gas leaves the evaporator 206.

If more than one compressor 202 is present, when a second compressor 202-2 is staged on, the EXV 210 is opened by an additional amount (e.g., 15%) relative to its current state, for a specified second amount of time (e.g., twenty seconds) prior to the power-on of the second compressor 202-2. After the specified second amount of time has elapsed, the EXV 210 is allowed to modulate the percentage open automatically in order to achieve a particular SH temperature value.

When a compressor 202 is staged off in connection with, e.g., multiple compressor circuits, the EXV 210 is anticipatorily moved or closed by a given percentage (e.g., 10%) relative to its current position, for a specified third amount of time (e.g., twenty seconds) prior to the compressor 202 shutdown. After that compressor is powered off, the EXV 210 is allowed to modulate the percentage open automatically in order to achieve a particular SH temperature value.

Thus, as described above, the anticipatory movement of the EXV 210 is used to prepare the air conditioning refrigeration circuit for increased or decreased refrigerant flow. This anticipatory movement of the EXV 210 helps to prevent the system 200 from being subject to spikes or large changes in pressure or temperature.

Figure 3:
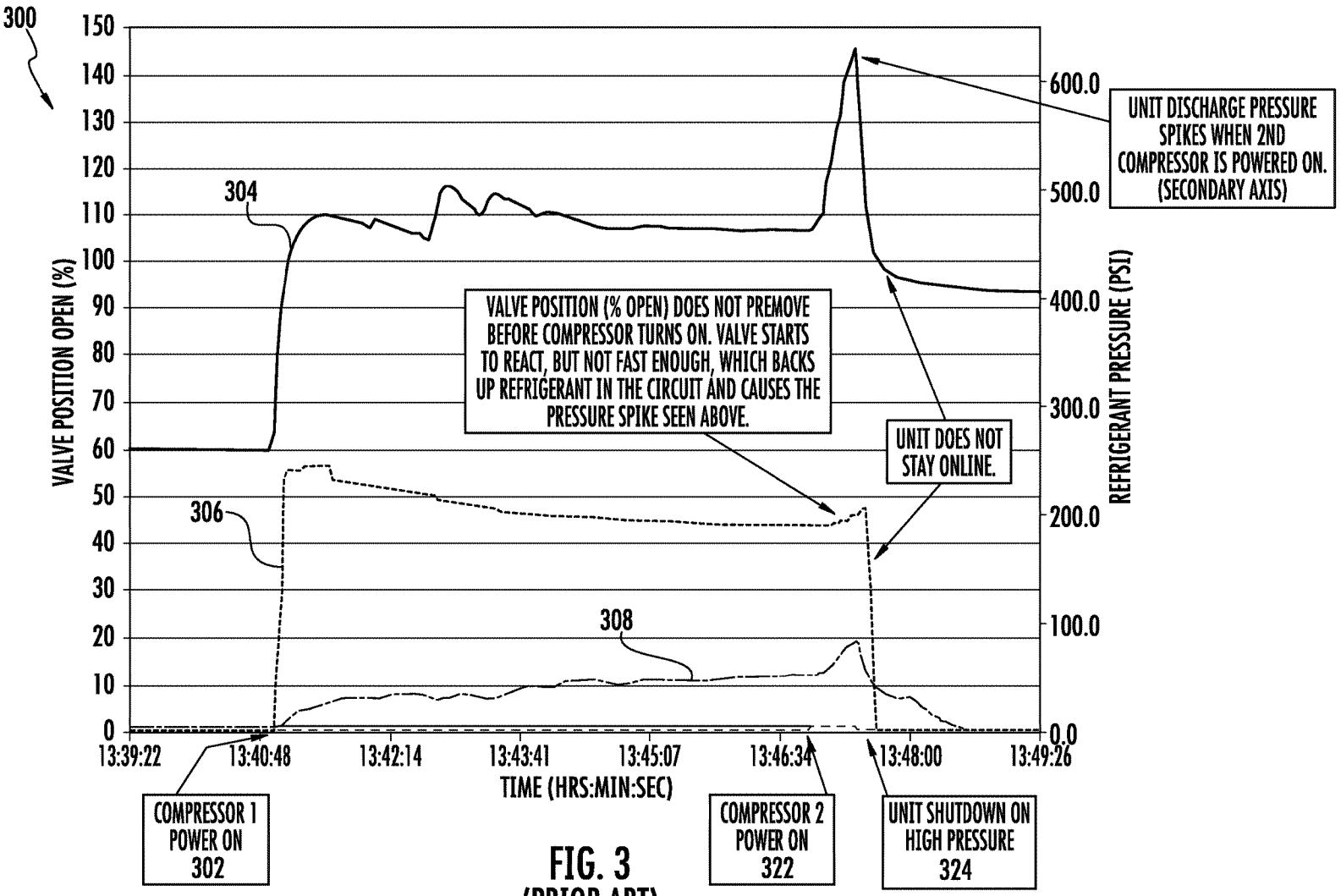
FIG. 3 (PRIOR ART)
FIG. 3 illustrates a timeline associated with an air conditioning system in accordance with the prior art.

Turning now to FIG. 3, a timeline or graph 300 associated with the prior art is shown. The timeline 300 is associated with a multi-compressor air conditioning unit or system in accordance with the prior art.

As shown in FIG. 3, the left-hand vertical axis corresponds to the percentage that a valve (e.g., a pressure relief valve) is opened. The right-hand vertical axis corresponds to refrigerant pressure as measured in, e.g., pounds per square inch (psi). At a first time instant 302, a first compressor is powered-on. The turning-on of the first compressor at time instant 302 causes a jump or step in a discharge pressure curve 304 (e.g., from approximately 250 psi to approximately 450 psi). The turning-on of the first compressor at time instant 302 further causes a jump or step in a percentage open curve 306 for an EXV (e.g., from approximately 0% open to approximately 55% open).

At a second time instant 322, a second compressor is powered-on. The EXV starts to react to the turn-on of the second compressor, but might not do so fast enough, such that a spike is generated in the pressure curve 304 (e.g., from approximately 450 psi to approximately 625 psi). A spike is also generated in a SH curve 308 for the refrigerant. Due to a lack of a anticipatory movement of the EXV, and as a result of the spike in the pressure, the unit shuts down at a third time instant 324. Based on the unit shutdown, the profile of the pressure curve 304 experiences a decline or decay (e.g., from approximately 625 psi to approximately 400 psi), and the profile of the percentage open curve 306 for the EXV undergoes an approximate step decrease (e.g., from approximately 50% open to approximately 0% open).

Figure 4:
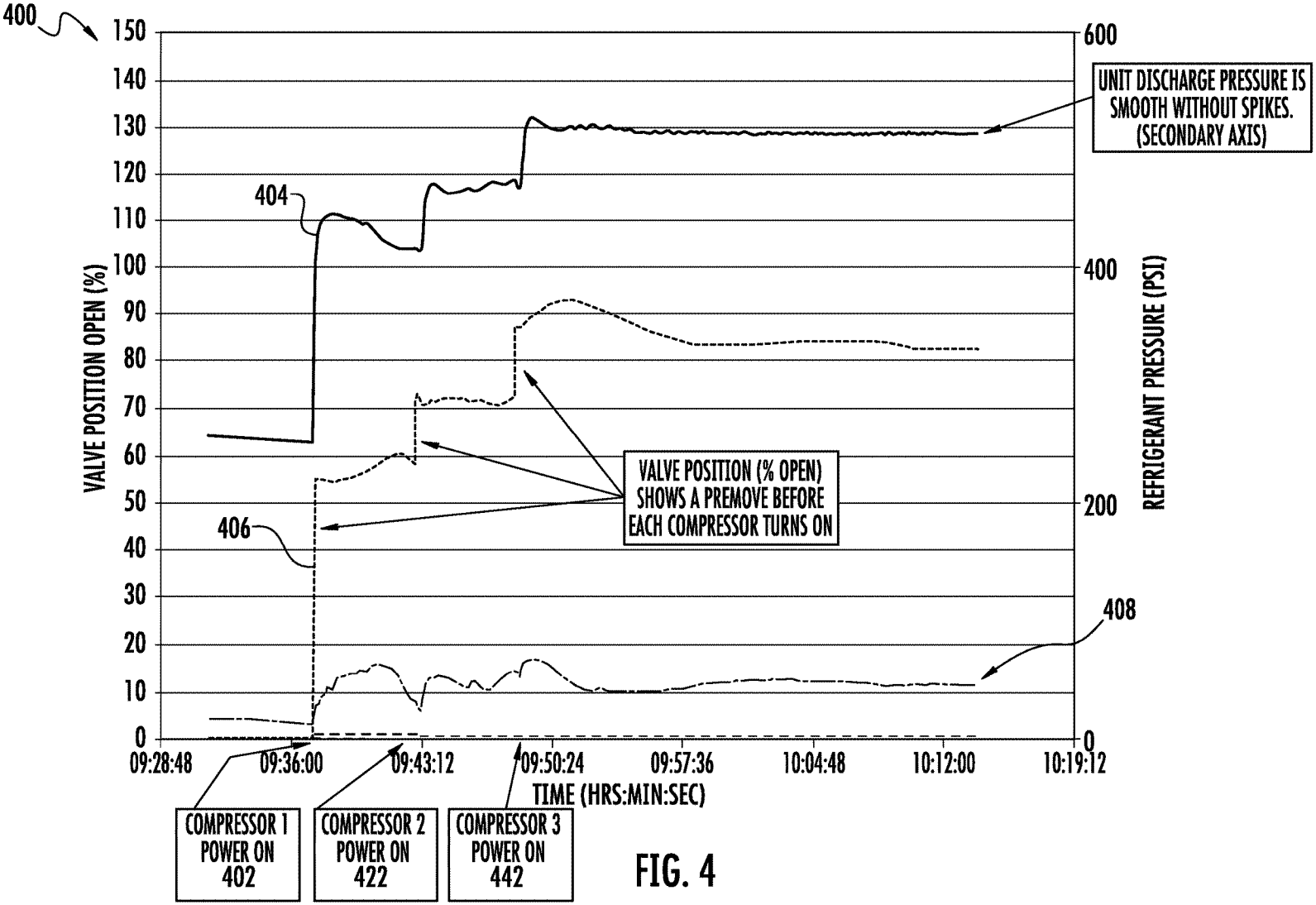
FIG. 4 illustrates a timeline associated with an air conditioning system in accordance with one or more embodiments.

Turning now to FIG. 4, a timeline or graph 400 associated with one or more exemplary embodiments is shown. The timeline 400 is associated with a multi-compressor air conditioning unit or system, such as the system 200 of FIG. 2.

As shown in FIG. 4, the left-hand vertical axis corresponds to the percentage that a valve (e.g., an EXV) is opened. The right-hand vertical axis corresponds to refrigerant pressure as measured in, e.g., psi. At a first time instant 402, a first compressor is powered-on. A threshold amount of time before the first compressor is powered on at time instant 402, a valve (e.g., EXV 210) is opened to a greater extent (e.g., from approximately 0% open to approximately 55% open) as shown via a percentage open curve 406. The turn on of the first compressor at time instant 402 causes a step in a discharge pressure curve 404 (e.g., from approximately 250 psi to approximately 440 psi).

At a second time instant 422, a second compressor is powered-on. A threshold amount of time before the second compressor is powered on at time instant 422, the valve (e.g., EXV) is opened to a greater extent (e.g., from approximately 55% open to approximately 70% open) as shown via the percentage open curve 406. The turn on of the second compressor at time instant 422 causes a step in the discharge pressure curve 404 (e.g., from approximately 420 psi to approximately 470 psi).

At a third time instant 442, a third compressor is powered-on. A threshold amount of time before the third compressor is powered on at time instant 442, the valve is opened to a greater extent (e.g., from approximately 70% open to approximately 90% open) as shown via the percentage open curve 406. The turn on of the third compressor at time instant 442 causes a step in the discharge pressure curve 404 (e.g., from approximately 470 psi to approximately 560 psi).

A comparison of the timelines/graphs 300 and 400 indicates that by moving or opening a valve (e.g., EXV) in advance of a compressor turn on or power-on, spikes in the profile of a discharge pressure curve are reduced or eliminated. Furthermore, the spike present in the SH curve 308 of FIG. 3 is not present in the SH curve 408 of FIG. 4. Accordingly, an air conditioning unit or system may operate more smoothly or more efficiently and may be subjected to less stress. As such, an operational lifetime for the unit/system may be extended.

Figure 5:
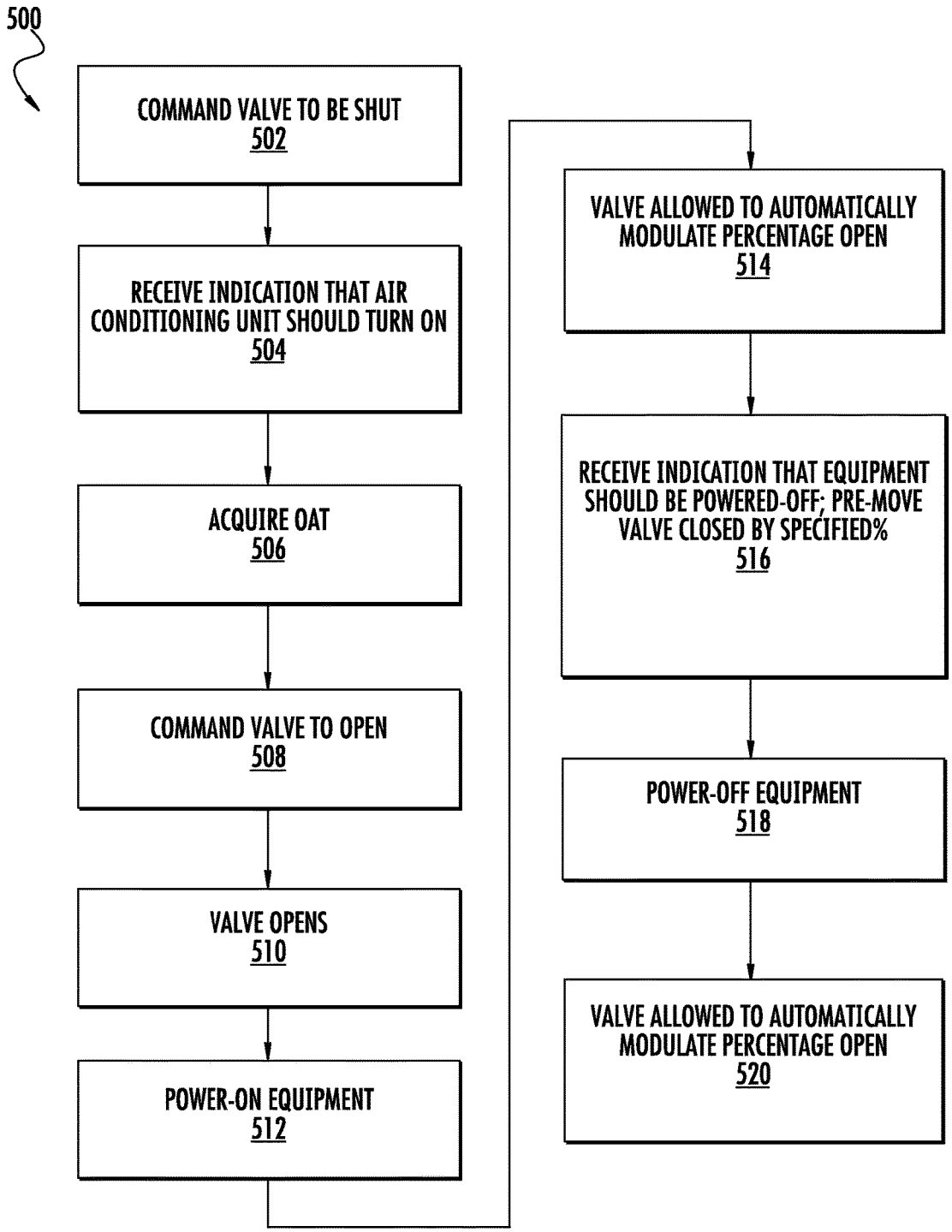
FIG. 5 illustrates a flow chart of an exemplary method in accordance with one or more embodiments.

Turning now to FIG. 5, a flow chart of an exemplary method 500 is shown. The method 500 may be executed in connection with one or more components, devices, or systems, such as those described herein (e.g., system 200 of FIG. 2). The method 500 is used to control a valve of an air conditioning system or unit. The valve is used to provide pressure or temperature relief.

In block 502, the valve is commanded to be shut. Such a state may correspond to the air conditioning unit being off.

In block 504, an indication is received that the air conditioning unit should be turned on. The received indication may take one or more forms and may originate from one or more components, such as a signal received from a thermostat.

In block 506, the outside air temperature (OAT) is acquired.

In block 508, the valve is commanded to open, potentially as a function of the OAT acquired in block 506. For example, the valve is commanded to open by a percentage specified by equation #1 above.

In block 510, the valve is opened based on the command of block 508. Once the valve is open to the extent specified in block 508, flow proceeds from block 510 to block 512.

In block 512, a compressor, a fan, or any other piece of equipment that may have an impact on refrigerant flow is powered-on. Flow remains in block 512 for a threshold amount of time, in order to allow a refrigerant circuit to stabilize. Once the threshold amount of time has expired, flow proceeds to block 514.

In block 514, the valve is allowed to automatically modulate the percentage open parameter in order to obtain a specified SH temperature value.

In block 516, an indication is received that the equipment, or a portion thereof, should be powered-off. In response to the received indication of block 516, the valve is anticipatorily moved (e.g., closed) by a specified percentage (e.g., 10% less than a current position). Flow remains in block 516 for a threshold amount of time, in order to allow a refrigerant circuit to stabilize. Once the threshold amount of time has expired, flow proceeds to block 518.

In block 518, the equipment, or portion thereof, is powered-off.

In block 520, the valve is allowed to automatically modulate the percentage open parameter in order to obtain the specified SH temperature value.

The method 500 is illustrative. In some embodiments, one or more of the blocks or operations (or portions thereof) may be optional. In some embodiments, additional operations not shown may be included. In some embodiments, the operations may execute in an order or sequence different from what is shown.

Embodiments of the disclosure may be tied to one or more particular machines. For example, one or more devices, apparatuses, systems, or architectures may be configured to anticipatorily move a valve (e.g., an electronically controlled expansion valve) in advance of a change in state to a fan or compressor of an air conditioning unit. The anticipatory movement of the valve prepares a refrigeration circuit for increased or decreased refrigerant flow. This anticipatory movement of the valve prevents a spike in pressure or superheat, thereby avoiding a safety-related shutdown of the air conditioning unit. The anticipatory movement of the valve helps the air conditioning unit operate more smoothly, without high pressure movements/changes and temperature movements/changes.

As described herein, in some embodiments various functions or acts take place at a given location and/or in connection with the operation of one or more apparatuses, systems, or devices. For example, in some embodiments, a portion of a given function or act is performed at a first device or location, and the remainder of the function or act is performed at one or more additional devices or locations.

Embodiments may be implemented using one or more technologies. In some embodiments, an apparatus or system includes one or more processors, and memory storing instructions that, when executed by the one or more processors, cause the apparatus or system to perform one or more methodological acts as described herein. Various mechanical components known to those of skill in the art may be used in some embodiments.

Embodiments are implemented as one or more apparatuses, systems, and/or methods. In some embodiments, instructions are stored on one or more computer-readable media, such as a transitory and/or non-transitory computer-readable medium. The instructions, when executed, cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method for operating an air conditioning unit, comprising:

receiving, by a device comprising a processor, an indication that a first piece of equipment that has an impact on refrigerant flow in the air conditioning unit should turn on;

commanding, by the device, a valve to open a first specified extent based on the received indication; and subsequent to the valve opening to the first specified extent, powering-on the first piece of equipment;

receiving, by the device, an indication that a second piece of equipment that has an impact on refrigerant flow in the air conditioning unit should turn on;

commanding, by the device, the valve to open a second specified extent different than the first specified extent; and subsequent to the valve opening to the second specified extent, powering-on the second piece of equipment with the valve open to the second specified extent.

2. The method of claim 1, wherein the first and second piece of equipment comprises at least one of a compressor and a fan.

3. The method of claim 1, further comprising:

acquiring, by the device, an outside air temperature, wherein the first specified extent is based on the acquired outside air temperature.

4. The method of claim 1, further comprising:

subsequent to powering-on at least one of the first and second piece of equipment, waiting for a threshold amount of time to expire; and subsequent to the threshold amount of time expiring, automatically modulating a percentage that the valve is open in order to obtain a specified superheat temperature value.

5. The method of claim 1, further comprising:

subsequent to powering-on at least one of the first and second piece of equipment, receiving an indication that the at least one of the first and second piece of equipment should be powered-off;

commanding, by the device, the valve to close a third specified extent based on the received indication that the piece of equipment should be powered-off; and subsequent to the valve closing to the third specified extent, powering-off the at least one of the first and second piece of equipment.

6. The method of claim 5, further comprising:

subsequent to powering-off the at least one of the first and second piece of equipment, waiting for a threshold amount of time to expire; and subsequent to the threshold amount of time expiring, automatically modulating a percentage that the valve is open in order to obtain a specified superheat temperature value.

7. The method of claim 1, wherein the indication is received as a signal from a thermostat.

8. An apparatus comprising:

at least one processor; and memory having instructions stored thereon that, when executed by the at least one processor, cause the apparatus to:

receive an indication that a first piece of equipment that has an impact on refrigerant flow in the air conditioning unit should turn on;

command a valve to open a first specified extent based on the received indication; and subsequent to the valve opening to the first specified extent, power-on the first piece of equipment;

receive an indication that a second piece of equipment that has an impact on refrigerant flow in the air conditioning unit should turn on;

command the valve to open a second specified extent different than the first specified extent; and subsequent to the valve opening to the second specified extent, power-on the second piece of equipment with the valve open to the second specified extent.

9. The apparatus of claim 8, wherein the first and second piece of equipment comprises at least one of a compressor and a fan.

10. The apparatus of claim 8, wherein the instructions, when executed by the at least one processor, cause the apparatus to:

acquire an outside air temperature, wherein the first specified extent is based on the acquired outside air temperature.

11. The apparatus of claim 8, wherein the instructions, when executed by the at least one processor, cause the apparatus to:

subsequent to powering-on at least one of the first and second piece of equipment, wait for a threshold amount of time to expire; and subsequent to the threshold amount of time expiring, automatically modulate a percentage that the valve is open in order to obtain a specified superheat temperature value.

12. The apparatus of claim 8, wherein the instructions, when executed by the at least one processor, cause the apparatus to:

subsequent to powering-on at least one of the first and second piece of equipment, receive an indication that the at least one of the first and second equipment should be powered-off;

command the valve to close a third specified extent based on the received indication that the at least one of the first and second of the equipment should be powered-off; and subsequent to the valve closing to the third specified extent, power-off the at least one of the first and second piece of equipment.

13. The apparatus of claim 12, wherein the instructions, when executed by the at least one processor, cause the apparatus to:

subsequent to powering-off the at least one of the first and second piece of equipment, wait for a threshold amount of time to expire; and subsequent to the threshold amount of time expiring, automatically modulate a percentage that the valve is open in order to obtain a specified superheat temperature value.

14. The apparatus of claim 8, wherein the indication is received as a signal from a thermostat.

15. An air conditioning unit comprising:

an expansion valve; and a computing device configured to prepare a refrigeration circuit for a change in refrigerant flow by changing an extent to which the expansion valve is opened in advance of changing a state of a first piece of equipment that has an impact on the refrigerant flow, the computing device configured to:

receive an indication that the first piece of equipment should turn on;

command the expansion valve to open a first specified extent based on the received indication; and subsequent to the expansion valve opening to the first specified extent, power-on the piece of equipment;

receive an indication that a second piece of equipment that has an impact on refrigerant flow in the air conditioning unit should turn on;

command the expansion valve to open a second specified extent different than the first specified extent; and subsequent to the expansion valve opening to the second specified extent, power-on the second piece of equipment with the valve open to the second specified extent.

16. The air conditioning unit of claim 15, wherein the first and second piece of equipment comprises at least one of a compressor and a fan.

17. The air conditioning unit of claim 15, further comprising:

a sensor configured to obtain an outside air temperature, wherein the computing device is configured to specify the first specified extent to which the expansion valve is opened based on the outside air temperature obtained by the sensor.

18. The air conditioning unit of claim 15, wherein the air conditioning unit is included as part of a packaged rooftop air conditioning system.

* * * * *